US006196407B1

(12) United States Patent
Liu

(10) Patent No.: US 6,196,407 B1
(45) Date of Patent: Mar. 6, 2001

(54) GARBAGE CONTAINER

(75) Inventor: Kun-Hei Liu, Taipei (TW)

(73) Assignee: Green Wheel Industrial Co., Ltd., Taipei (TW)

( * ) Notice: Under 35 U.S.C. 154(b), the term of this patent shall be extended for 0 days.

(21) Appl. No.: 09/511,102

(22) Filed: Feb. 23, 2000

(51) Int. Cl.[7] ..... B65D 51/04
(52) U.S. Cl. ..... 220/263; 220/524; 220/909
(58) Field of Search ..... 220/262, 263, 220/264, 524, 528, 529, 909

(56) References Cited

U.S. PATENT DOCUMENTS 4,785,964 * 11/1988 Miller et al. ..... 220/263
4,972,966 * 11/1990 Craft, Jr. ..... 220/263
5,249,693 * 10/1993 Gillispie et al. ..... 220/263
5,295,607 * 3/1994 Chang ..... 220/263
5,531,348 * 7/1996 Baker et al. ..... 220/263
5,782,359 * 7/1998 McAllister et al. ..... 220/524
6,019,242 * 2/2000 Wysocki et al. ..... 220/524

* cited by examiner

*Primary Examiner*—Joseph M. Moy
(74) *Attorney, Agent, or Firm*—Varndell & Varndell, PLLC

(57) ABSTRACT

A garbage container includes a base, a bottom cover rotatably supported on the base to hold an outer shell and an inner barrel, a plurality of partition boards fastened to the bottom cover and defining a plurality of storage chambers within the outer shell around the inner barrel for receiving classified waste materials, a top cover covered on the outer shell over the storage chambers, an inner container formed of multiple container parts and mounted within the inner barrel, a plurality of cover panels respectively pivoted to the inner barrel and moved to close/open the storage chamber, and a foot lever pivoted to the base and operated to lift one container part or the inner container in opening one cover panel from one storage chamber.

2 Claims, 15 Drawing Sheets

GARBAGE CONTAINER

BACKGROUND AND SUMMARY OF THE INVENTION

The present invention relates to a garbage container, and more particularly to such a garbage container, which comprises multiple storage chambers for receiving classified waste materials.

Regular garbage containers are commonly made having only one holding space for colleting waste materials. For collecting differently classified waste materials, several garbage containers shall be used.

According to one aspect of the present invention, the garbage container comprises an inner container for holding pot flowers, umbrellas, etc., and multiple storage chambers spaced around the inner container for receiving classified waste material. According to another aspect of the present invention, the storage chambers are defined within an outer shell above a bottom cover, and the bottom cover is rotatably supported on a base. According to still another aspect of the present invention, the storage chambers are covered with a respective cover panels, and a foot lever is provided for operation with the foot to open one cover panel from the corresponding storage chamber.

DETAILED DESCRIPTION OF THE PREFERRED EMBODIMENT

Figure 1:
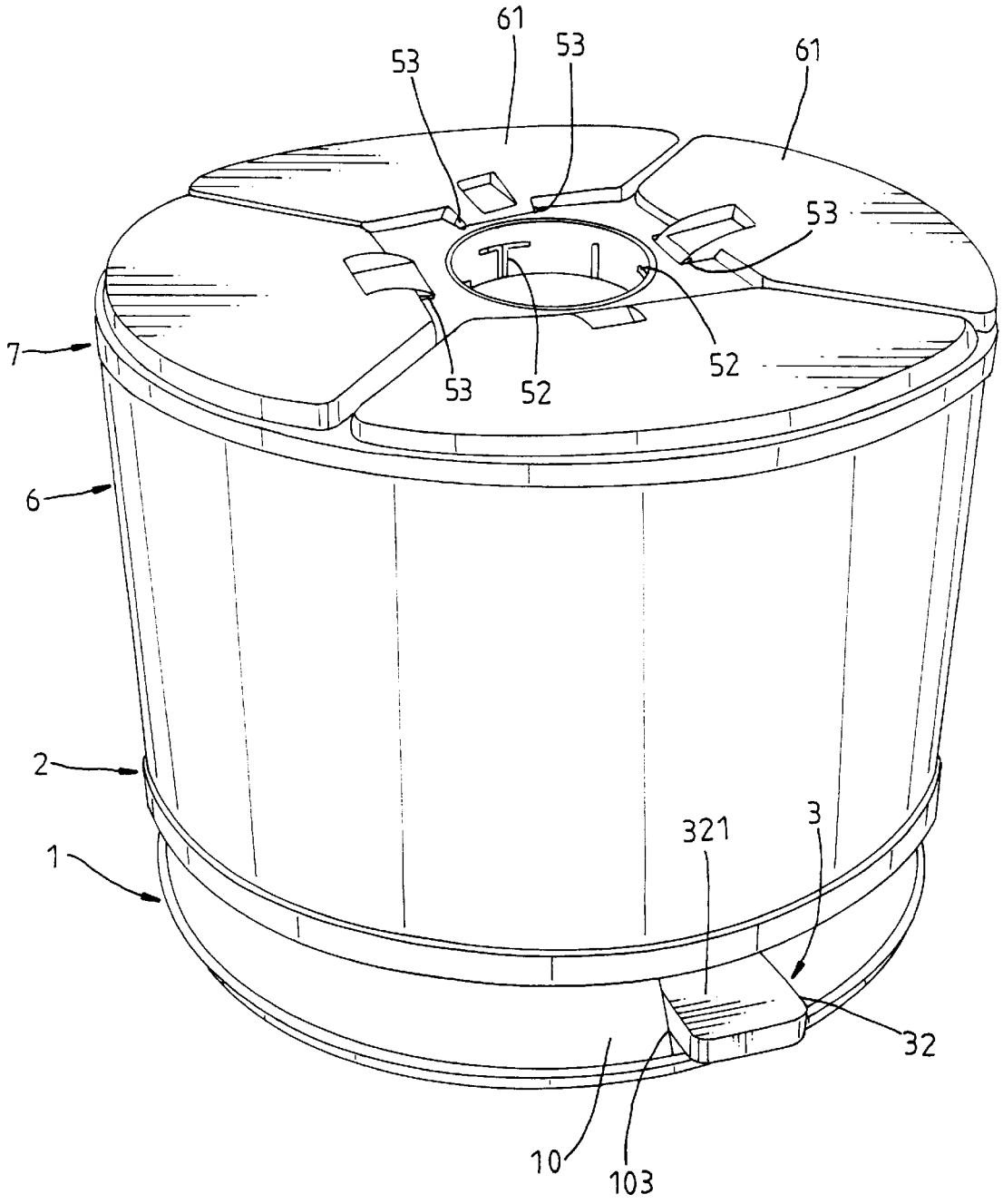
FIG. 1 is a perspective view of a garbage container according to the present invention.
Figure 2:
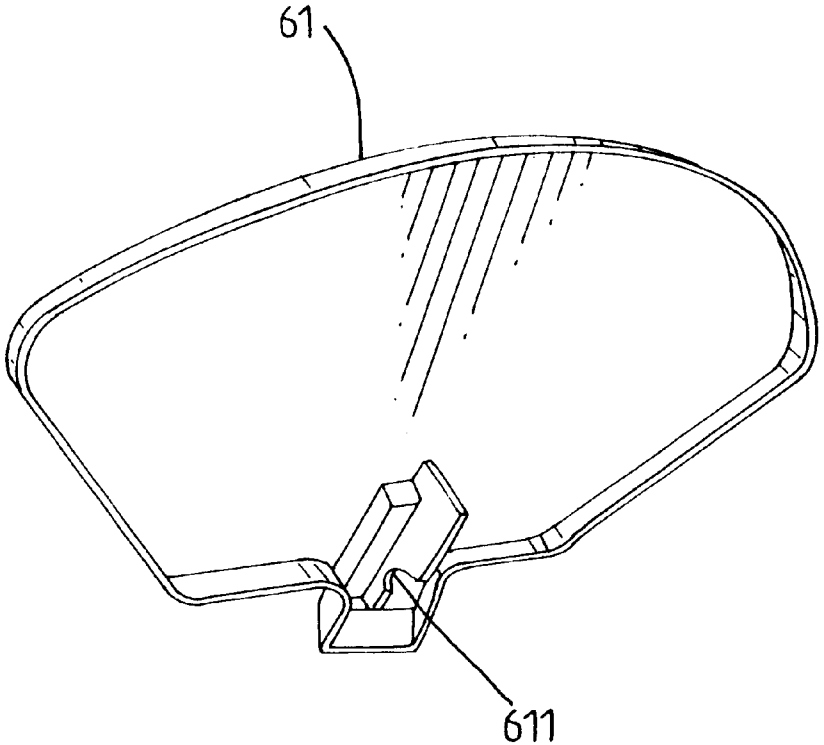
FIG. 2 is an oblique bottom view of a cover panel according for the garbage container shown in FIG. 1.
Figure 3:
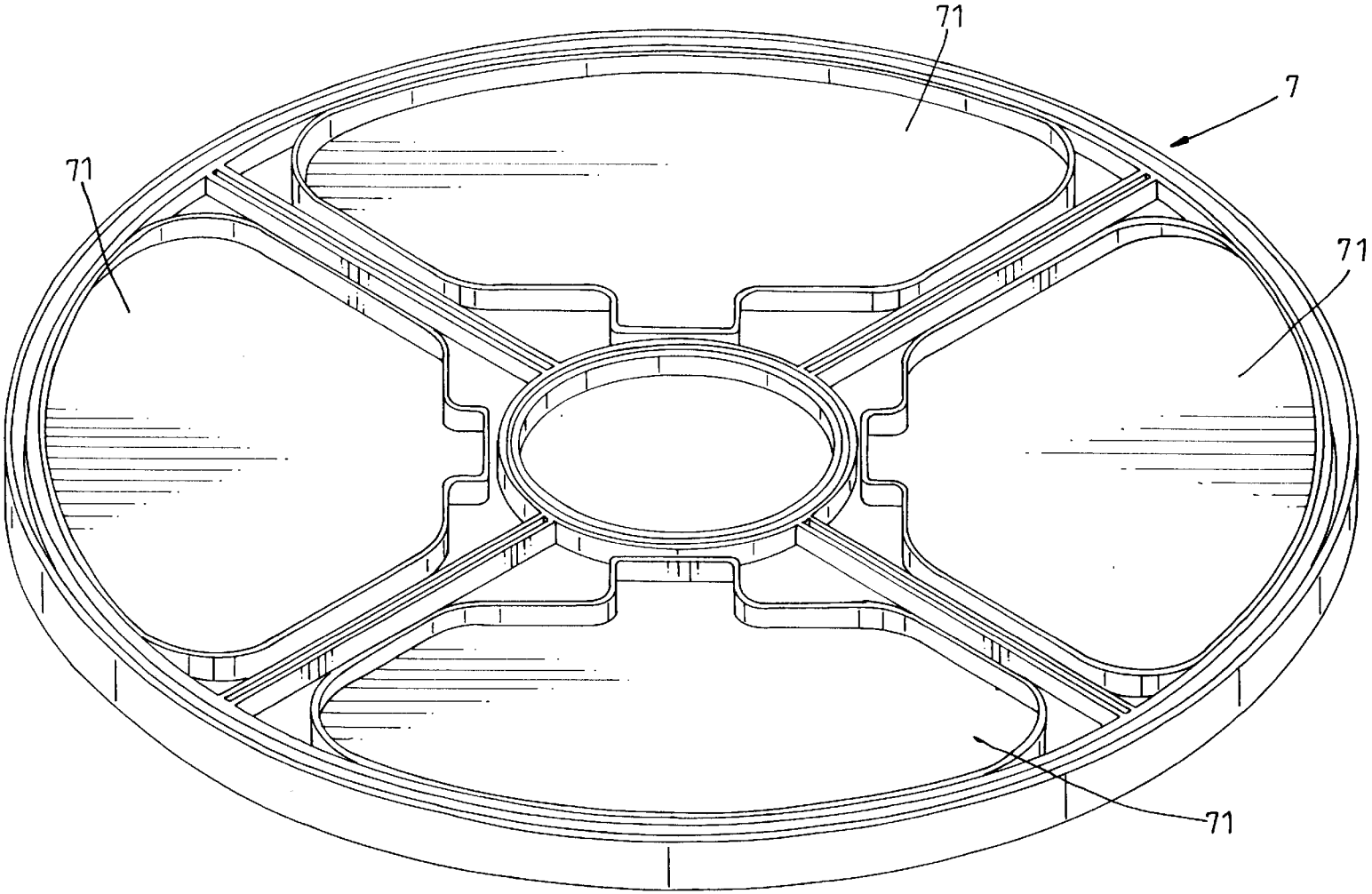
FIG. 3 is an oblique bottom view of the top cover for the garbage container shown in FIG. 1.
Figure 4:
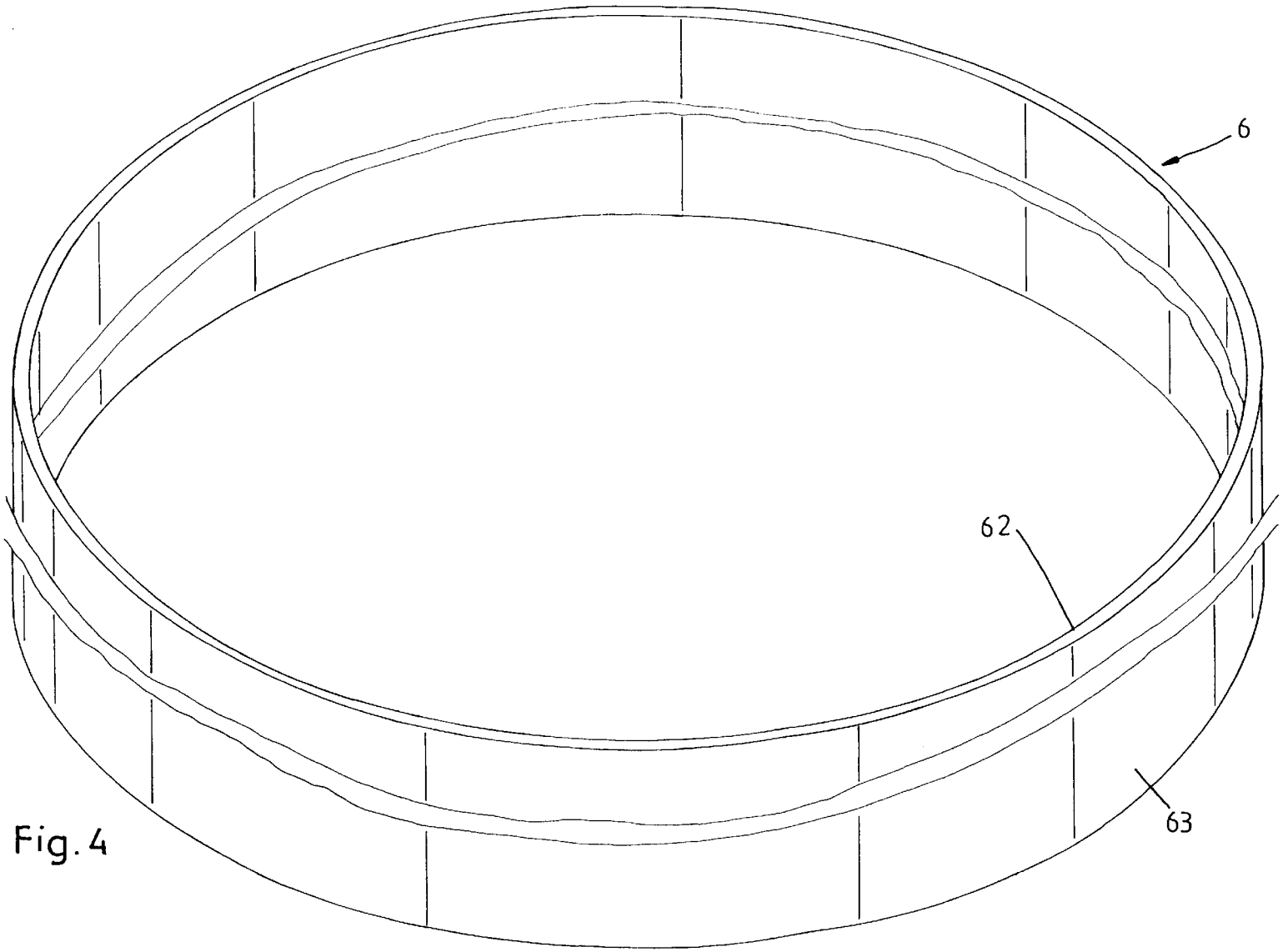
FIG. 4 is illustrates the structure of the outer shell for the garbage container shown in FIG. 1.

Referring to FIGS. from 1 through 13, a garbage container in accordance with the present invention is generally comprised of a base 1, a bottom cover 2, a foot lever 3, a spring member 30, an inner container 4, an inner barrel 5, an outer shell 6, a top cover 7, a plurality of cover panels 61, and a plurality of partition boards 8.

Referring to FIGS. from 10 througn 12, the base 1 is a dome-like hollow shell comprising a top center opening 11, an annular track 12 disposed around the top opening 11 for receiving an annular bottom coupling flange 21 of the bottom cover 2 for enabling the bottom cover 2 to be rotatably supported on the base 1, a side hole 103 for receiving the foot lever 3, and a spring holder 13 on the inside adjacent to the side hole 103.

Referring to FIGS. 8 through 12, the bottom cover 2 comprises an annular bottom coupling groove 21 coupled to the annular track 12 of the base 1, a hooked portion 2111 formed integral with an inner side wall 211 of the bottom coupling groove 21 and hooked on the bottom side of the annular track 12, a center tube 25 inserted into the top center opening 11 in the base 1, an inner annular coupling groove 23 disposed around the center tube 25 for receiving the inner barrel 5, an outer annular coupling groove 22 disposed along the circular border thereof for receiving the outer shell 6, an plurality of openings 20 defined between the center tube 25 and the inner annular coupling groove 23, and a plurality of radial locating grooves 24 respectively connected between the inner annular coupling groove 23 and the outer annular coupling groove 22 for receiving the partition boards 8.

Referring to FIGS. from 10 through 12, the spring member 30 is fastened to the spring holder 13 inside the base 1 to support the foot lever 3. The foot lever 3 is inserted through the side hole 103 on the base 1, having a middle part 31 pivoted to the hollow body 10 of the base 1 by a pivot 101, a push rod 33 formed integral with an inner end thereof for insertion into one opening 20 on the bottom cover 2, a press head 321 formed integral with the outer end 32 thereof and disposed outside the base 1. The outer end 32 of the foot lever 3 is supported on the spring member 30.

Figure 6:
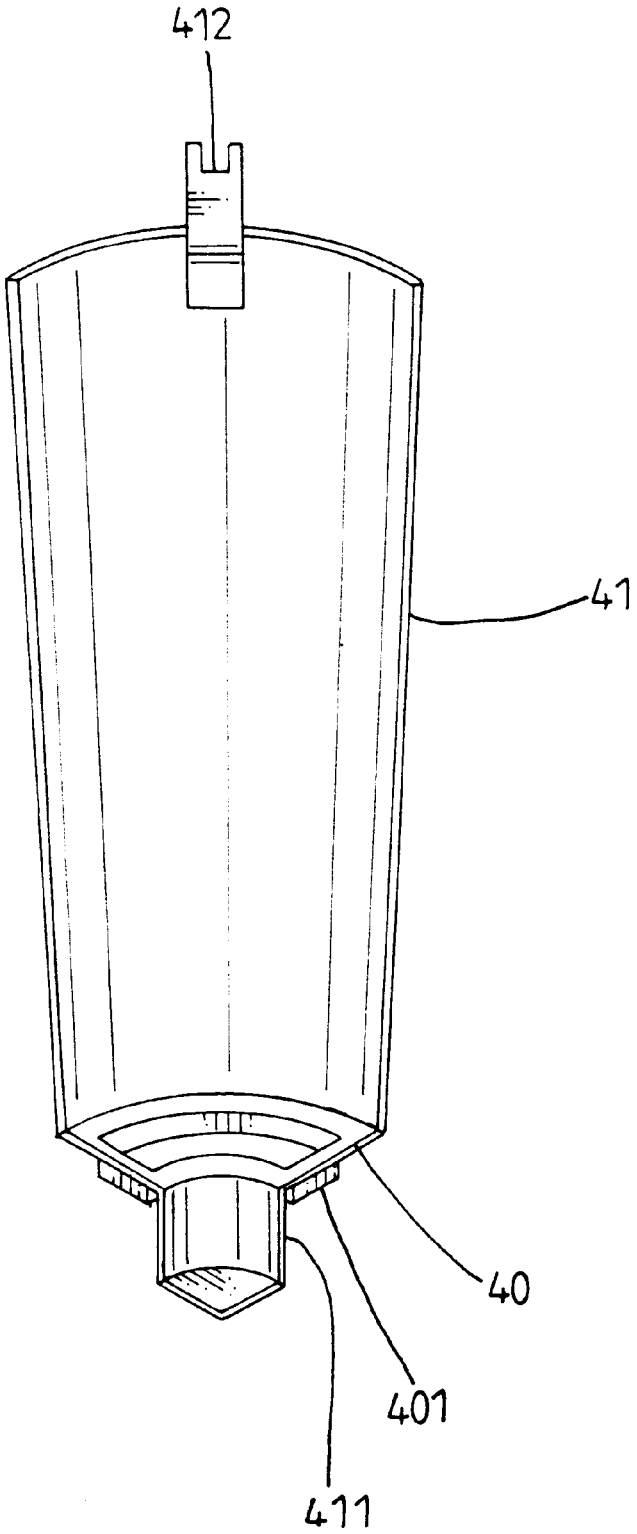
FIG. 6 is an elevational view of one containr part of the inner container for the garbage container shown in FIG. 1.
Figure 7:
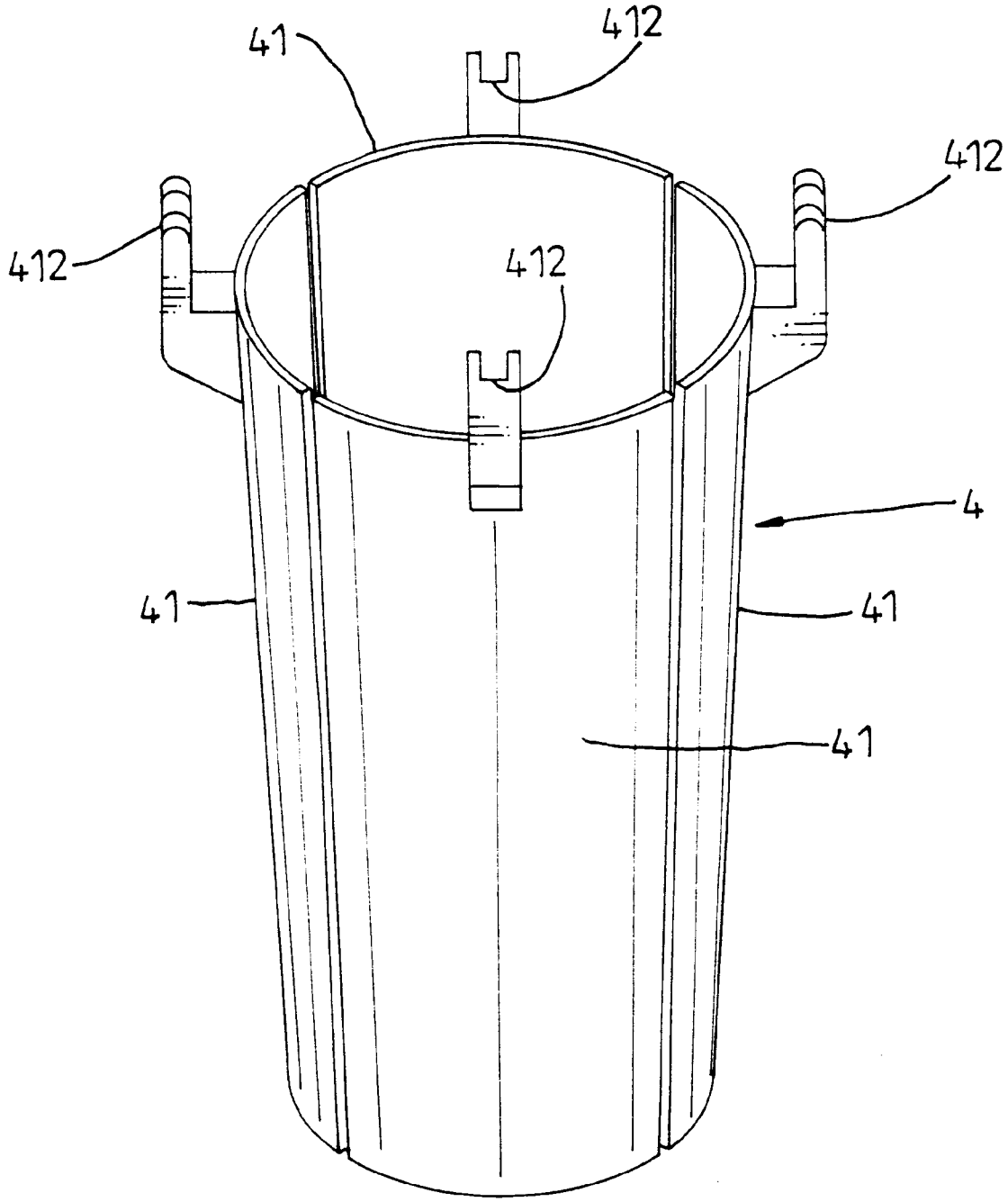
FIG. 7 is an elevational view of the inner container for the garbage container shown in FIG. 1.
Figure 8:
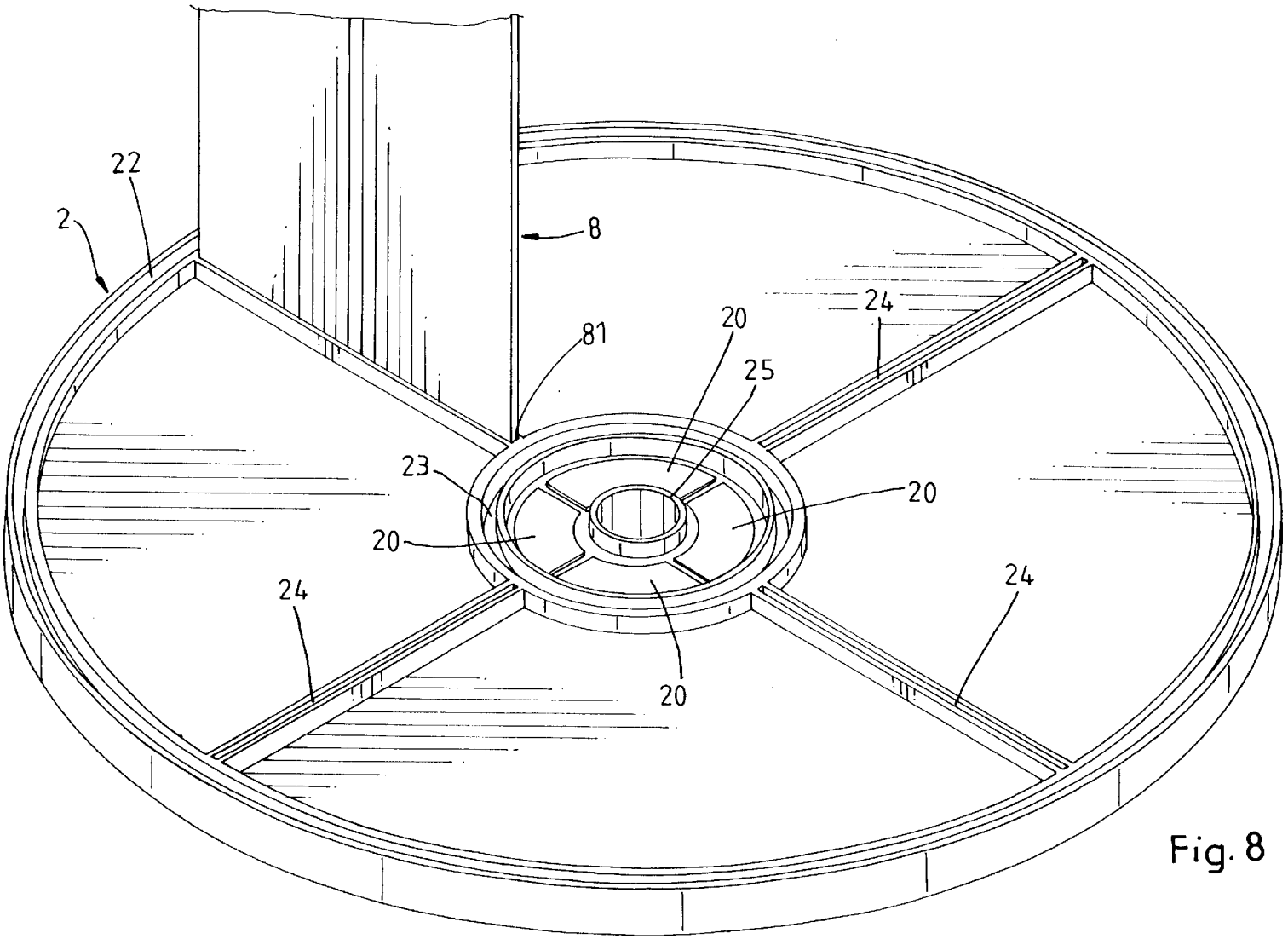
FIG. 8 is an oblique top view of a part of the present invention, showing one partition board fastened to one radial locating groove on the bottom cover.
Figure 9:
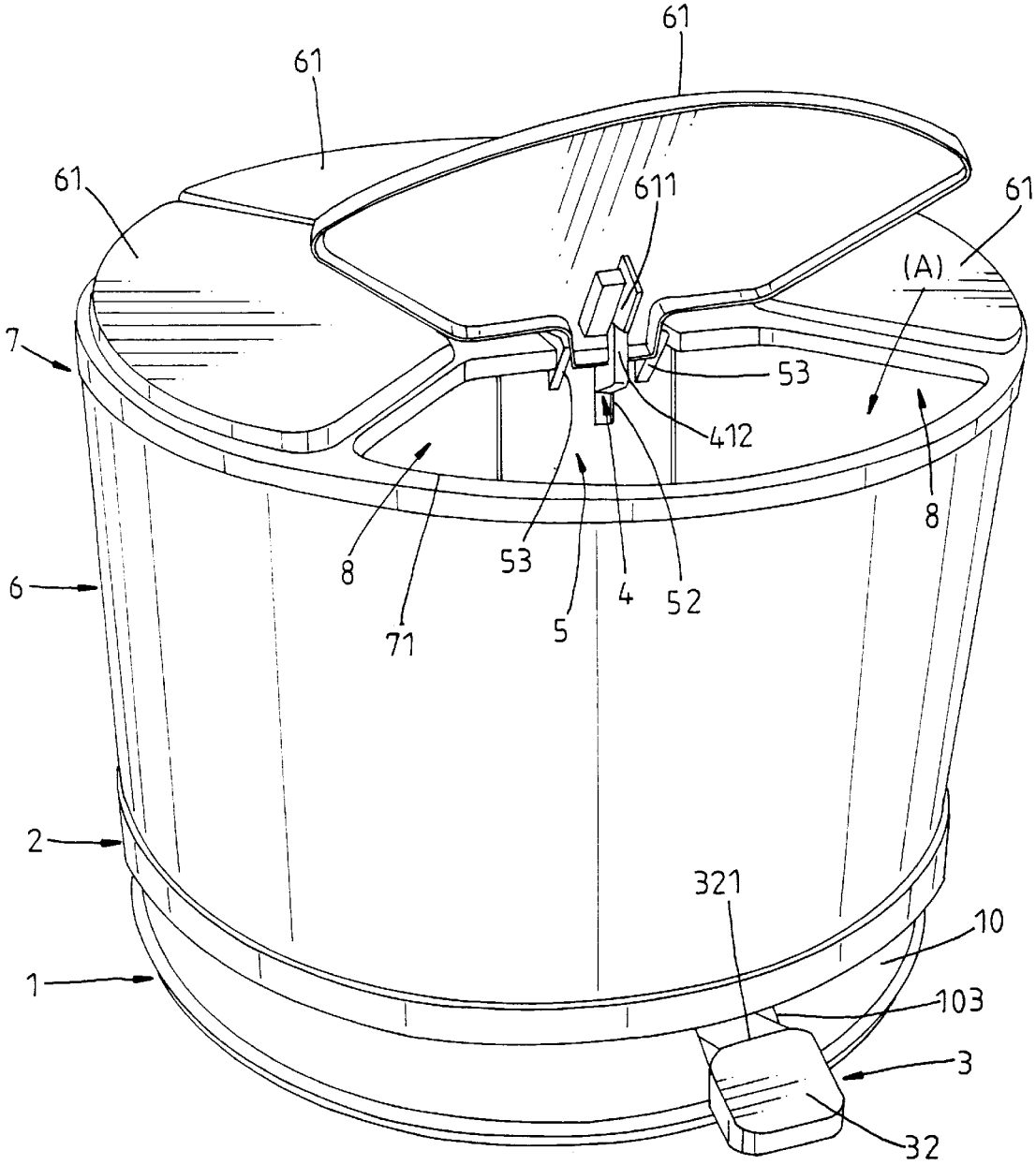
FIG. 9 is similar to FIG. 1 but shown one cover panel opened.
Figure 10:
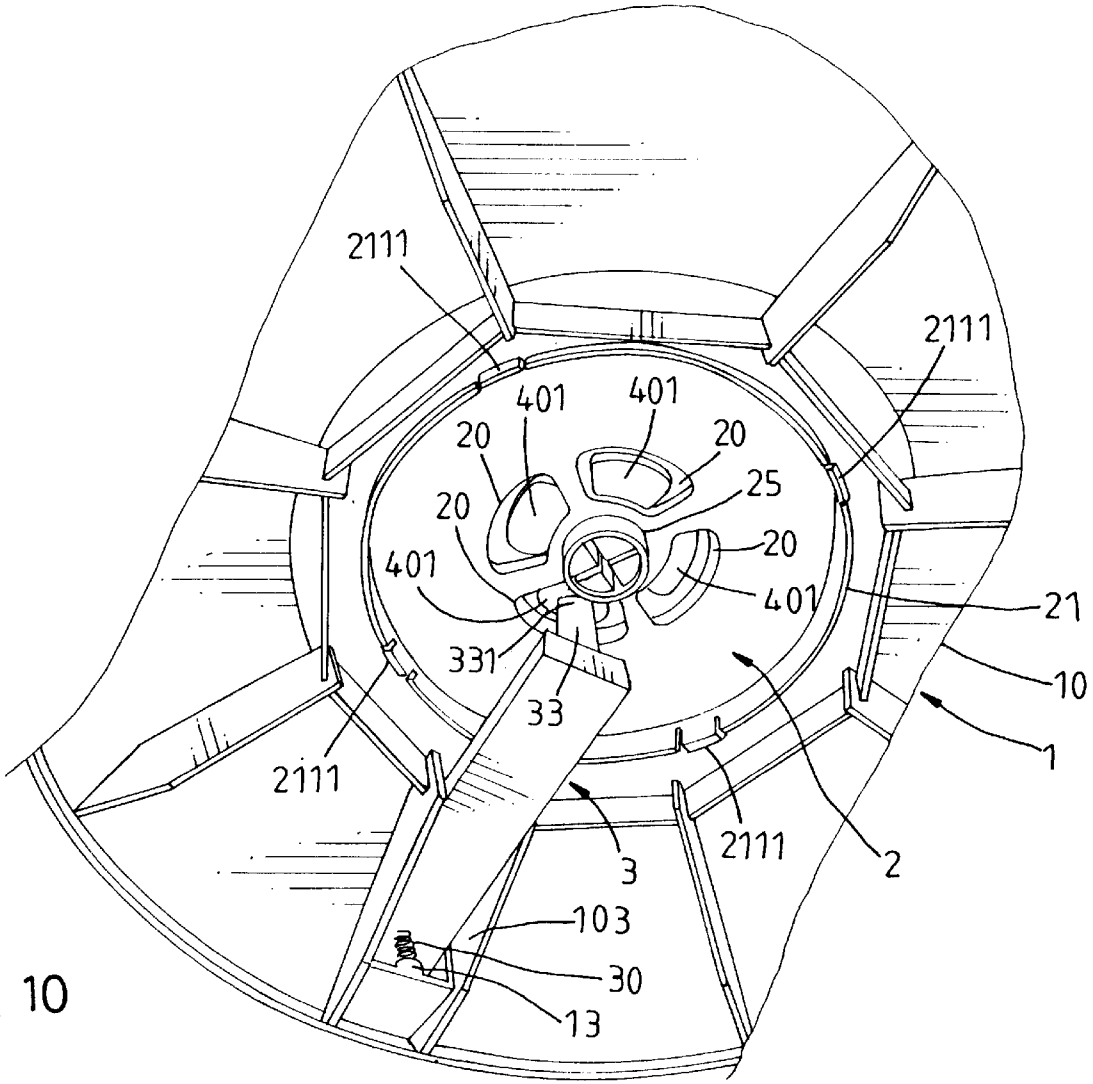
FIG. 10 is an oblique bottom view of a part of the present invention, showing the positioning of the foot lever in the base.
Figure 11:
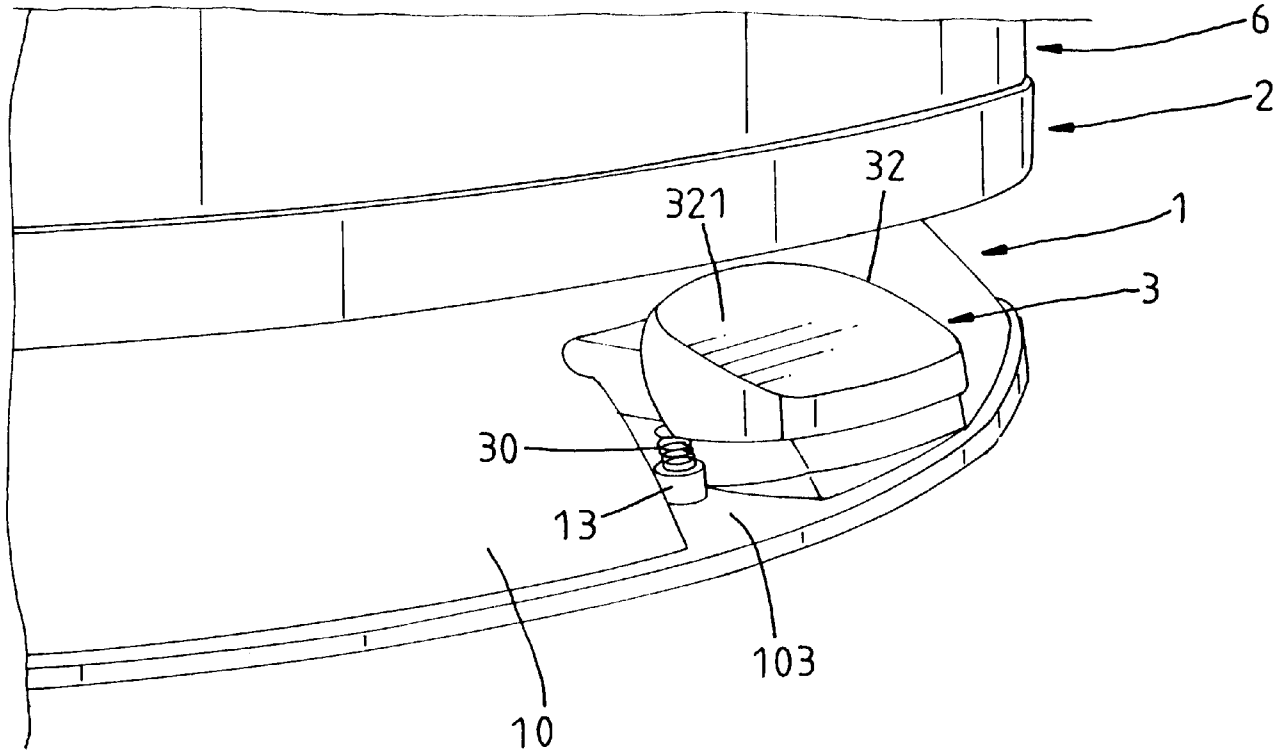
FIG. 11 is an elevational view of a part of the present invention, showing the foot lever extended out of the base.
Figure 12:
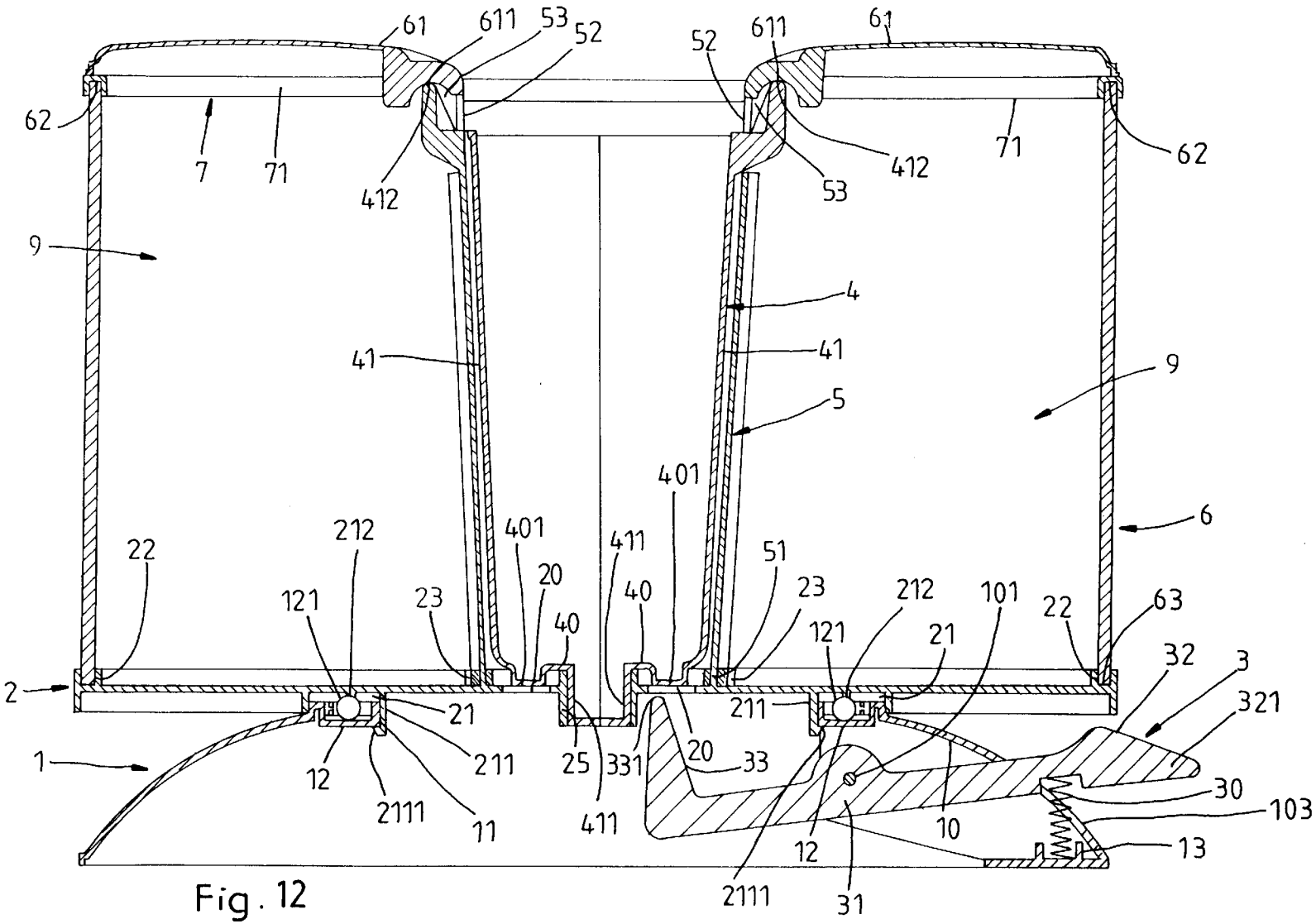
FIG. 12 is a sectional view of the present invention.
Figure 13:
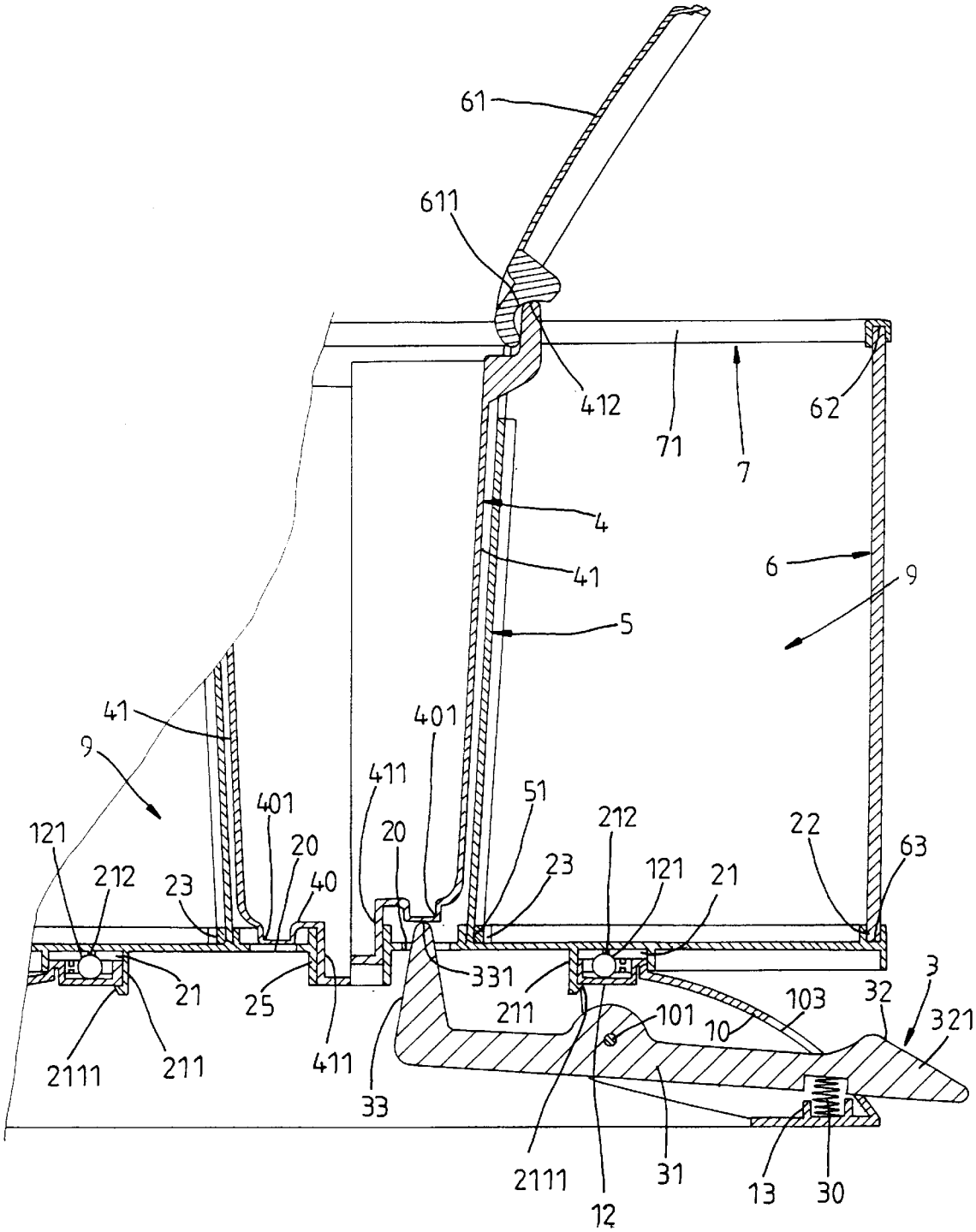
FIG. 13 is another sectional view of the present invention, showing the foot lever depressed, one cover panel opened.

Referring to FIGS. 6, 7 and 12, the inner container 4 is formed of a plurality of container parts 41 and mounted within the inner barrel 5. Each container part 41 comprises a bottom face 40, a bottom coupling rod 411 downwardly extended from the bottom face 40 and inserted into the center tube 25 of the bottom cover 2, a bottom flange 401 formed integral with the bottom face 40 and inserted into the openings 20 in the bottom cover 2 for contact with the top end 331 of the press rod 33 of the foot lever 3, and a top supporting rod 412 extended out of the inner barrel 5 and stopped at a part 611 of one cover panel 61.

Figure 5:
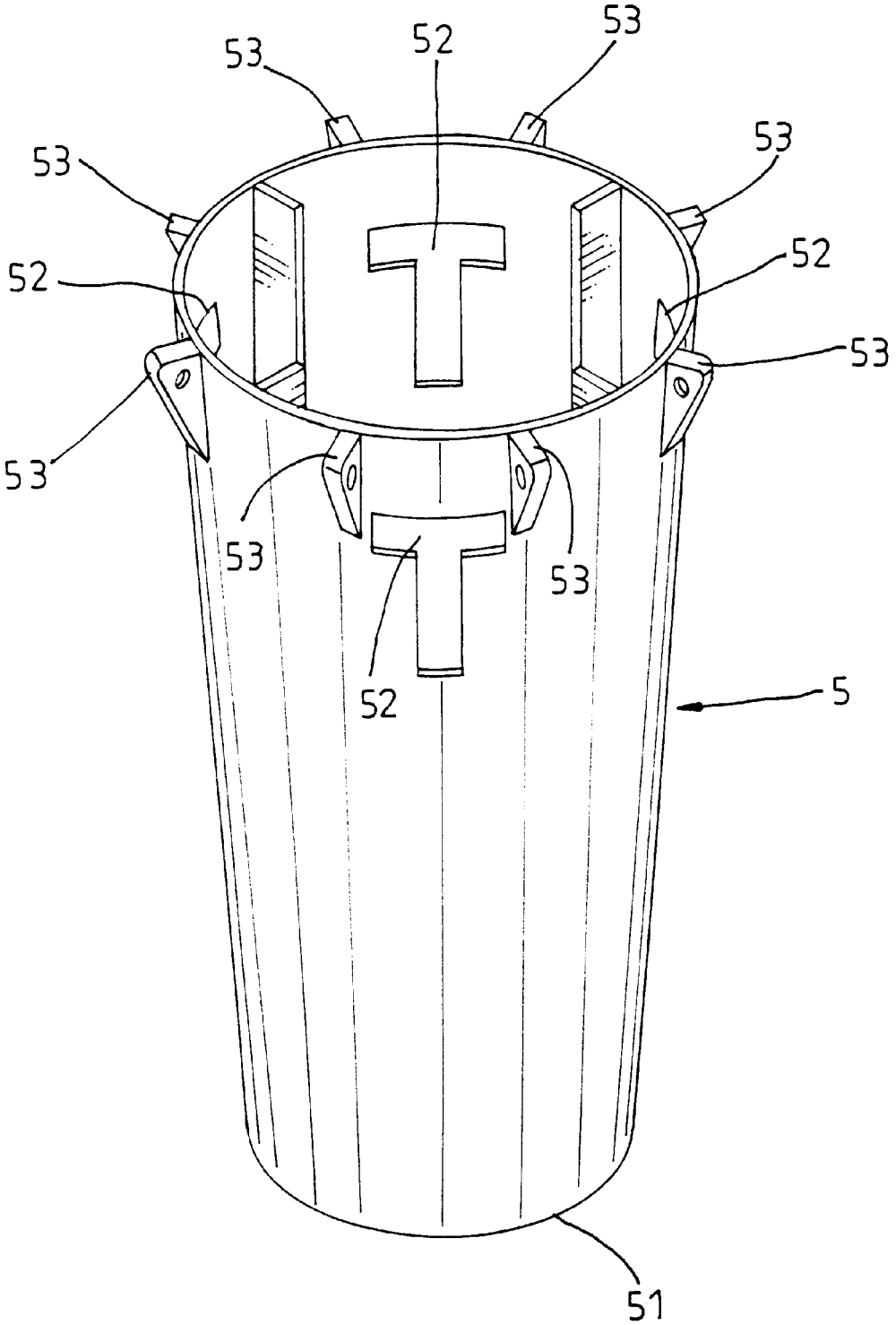
FIG. 5 is an elevational view of the inner barrel for the garbage container shown in FIG. 1.

Referring to FIGS. 5 and 12, the inner barrel 5 comprises a bottom coupling flange 51 coupled to the inner annular coupling groove 23 on the bottom cover 2, a plurality of peripheral openings 52 through which the top supporting rod 412 of each container part 31 of the inner container 4 passes, and a plurality of lugs 53 disposed near the top side thereof for holding the cover panels 61.

Referring to FIGS. 1, 4, 8, 9 and 12, the outer shell 6 is a cylindrical shell having a bottom edge 63 inserted into the outer annular coupling groove 22 on the bottom cover 2, a top edge 62 for supporting the top cover 7. The partition boards 8 each have a bottom side 81 respectively fastened to the radial locating grooves 24 on the bottom cover 2. After installtion of the partition boards 8 and the outer shell 6 in the bottom cover 2, the partition boards 8 define with the outer shell 6 multiple chambers 9.

Referring to FIGS. 1, 2, 3 and 9, the top cover 7 is covered on the top edge 62 of the outer shell 6, having a plurality of openings 71 slightly smaller than the cover panels 61. The cover panels 61 are respectivdly pivoted to the lugs 53 of the inner barrel 5 and moved to close/open the openings 71, each having a smoothly arched contact portion 611 disposed in contact with the top supporting rod 412 of one container part 41 of the inner container 4.

Referring to FIGS from 9 through 15, the inner container 4 and the chambers 9 are provided for receiving different things, for example, classified waste matter. Because the bottom cover 2 is rotatably coupled to the annular track 12 of the base 1, the user can rotate the outer shell 6 to shift the chambers 9. Further, when pressing the press head 321 of the foot lever 3 with the foot, the foot lever 3 is turned about the pivot 101 to lift the push rod 33, and simultaneously to compress the spring member 30. Because the top end 331 of the push rod 33 is disposed in contact with the bottom flanges 401 of one container part 41 of the inner container 4, lifting the push rod 33 causing the corresponding container part 41 to be moved upwards, and therefore the supporting rod 412 of the corresponding container part 41 is moved to open the corresponding cover panel 61 from the corresponding chamber 9. On the contrary, when the user releases the foot lever 3, the spring member 30 pushes the foot lever 3 back to its former position, enabling the corresponding container part 41 to be lowered with the push rod 33 of the foot lever 3, and therefore the corresponding cover panel 61 is returned to its former close position.

Referring to FIG. 12 again, a ball bearing 121 is installed in the annular track 12 in the base 1 and disposed in contact with a track 212 in the annular bottom coupling groove 21 at the bottom side of the bottom cover 2.

Figure 14:
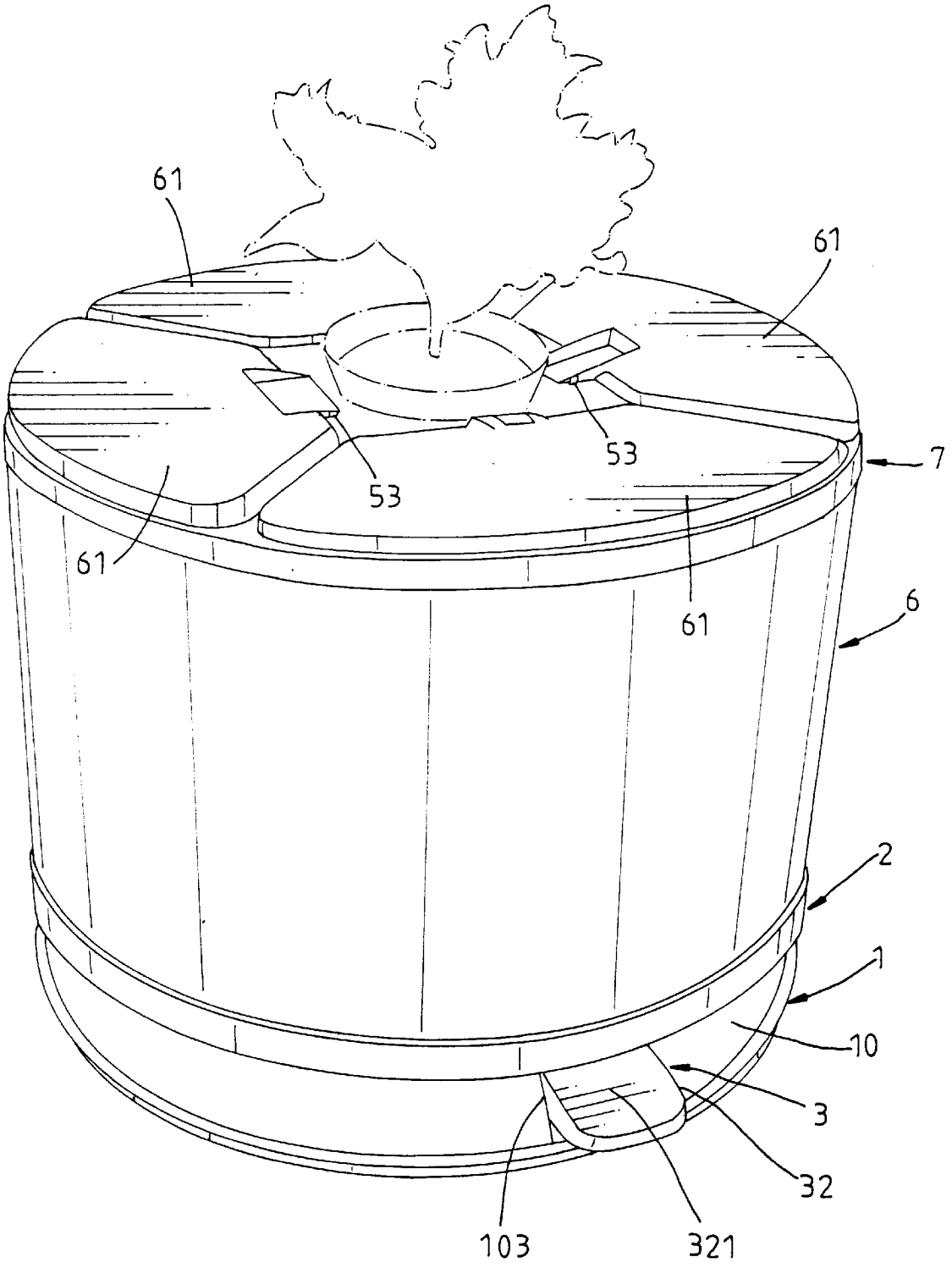
FIG. 14 is a schematic drawing showing a pot flower installed in the inner container of the garbage container according to the present invention.
Figure 15:
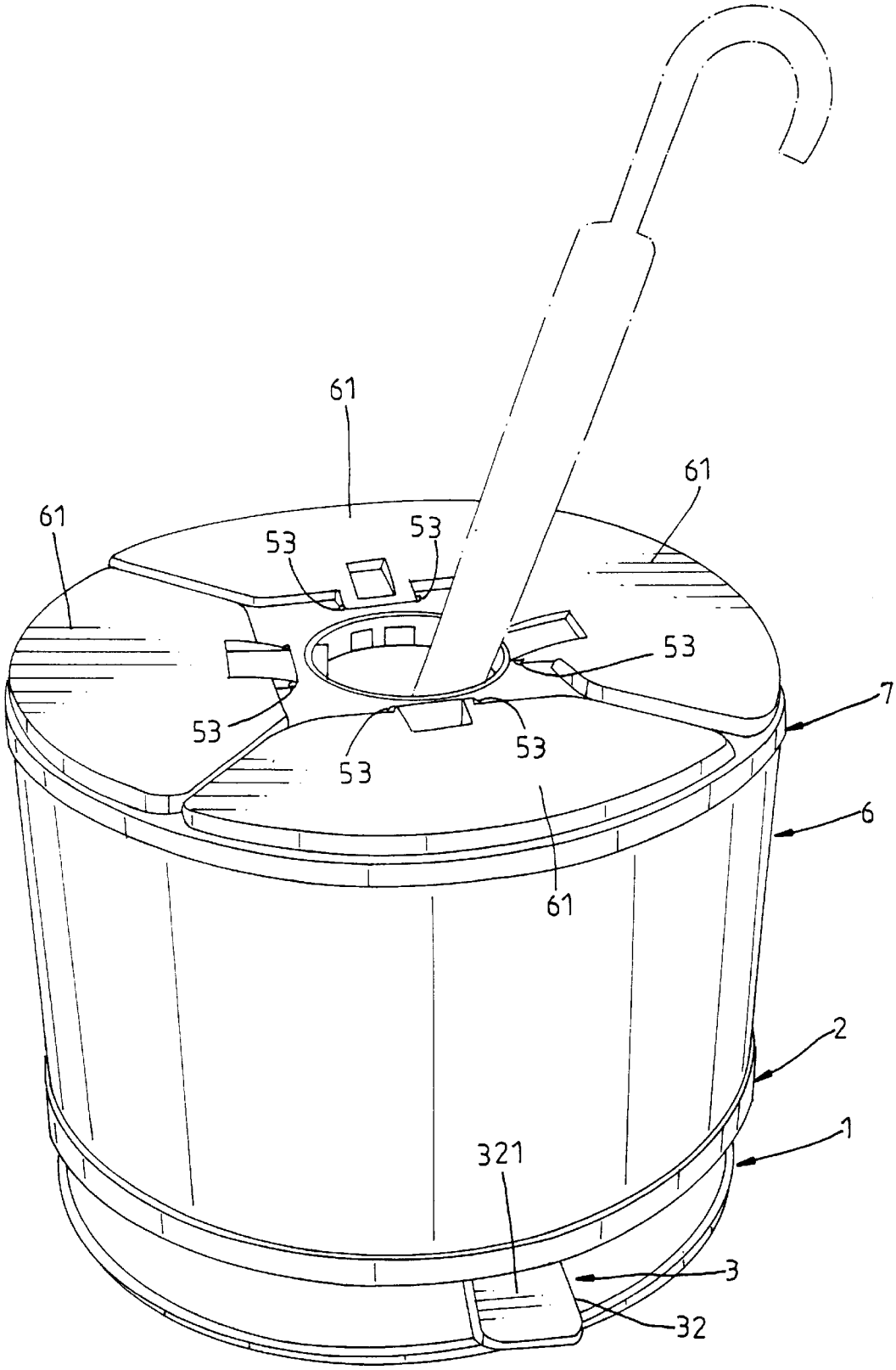
FIG. 15 is a schematic drawing showing an umbrella received in the inner container of the garbage container according to the present invention.

As indicated above, the garbage container has multiple chambers 9 for receiving classified waste matter, such as waste glass materials, waste aluminum materials, waste plastic materials, waste paper materials, etc. The inner contaienr 4 can be used to hold umbrellas (see FIG. 15), pot flowers (see FIG. 14). By means of rotating the outer shell 6 with the bottom cover 2, the user can shift the chambers 9 for easy loading of waste materials. After the assigned chamber 9 has been shifted to the position above the foot lever 3, is foot lever 3 is pressed with the foot to open the corresponding cover panel 61 from the assigned chamber 9 for the loading of a particular kind of waste matter.

What is claimed is:

1. A garbage container comprising:

a base, said base comprising a top center opening, an annular track disposed around the top opening, a side hole, and a spring hole on the inside adjacent to said side hole;

a bottom cover supported on said base and rotated on said annular track of said base, said bottom cover comprising an annular bottom coupling groove coupled to the annular track of said base, a hooked portion formed integral with an inenr side wall of said bottom coupling groove and hooked on a bottom side of said annular track of said base, a center tube inserted into the top center opening in said base, an inner annular coupling groove disposed around said center tube, an outer annular coupling groove disposed along the border thereof, a plurality of openings defined between said center tube and said inner annular coupling groove, and a plurality of radial locating grooves respectively connected between said inner annular coupling groove and said outer annular coupling groove;

a cylindrical outer shell mounted in the outer annular coupling groove on said bottom cover;

an inner barrel mounted on said bottom cover inside said outer shell, said inner barrel comprising a bottom coupling flange coupled to the inner annular coupling groove on said bottom cover, a plurality of peripheral openings, and a plurality of lugs disposed near a top side thereof;

an inner container formed of a plurality of container parts and mounted within said inner barrel, said container parts each comprising a bottom coupling rod downwardly extended from said bottom face and inserted into the center tube of said bottom cover, a bottom flange formed integral with said bottom face and inserted into one opening in said bottom cover, and a top supporting rod extended out of one peripheral opening on said inner barrel;

a plurality of partition board respectively fastened to said bottom cover and defining with said outer shell a plurality of storage chambers around said inner barrel, said partition boards each having a bottom side fastened to one radial locating groove on said bottom cover;

a top cover covered on said cylindrical outer shell and said partition boards, said top cover having a plurality of openings corresponding to said storage chambers;

a plurality of cover panels respectively pivoted to the lugs of said inner barrel and disposed in contact with the supporting rods of said container parts of said inner container and moved to close/open the openings on said top cover;

a spring member fastened to the spring holder inside said base; and a foot lever pivoted to said base and turned to lift one container part of said inner container in opening one cover panel from the corresponding opening on said top cover, said foot lever comprising a middle part pivoted to a part inside said base, a push rod upwardly extended from an inner end thereof and inserted through one opening on said bottom cover and disposed in contact with the bottom flange on the bottom face of one container part of said inner container, an outer end supported on said spring member, and a press head formed integral with said outer end and extended out of said base through the side hole on said base.

2. The garbage container of claim 1 further comprising a ball bearing installed in the annular track in said base to support said bottom cover on said base.

* * * * *